US007159908B2

(12) United States Patent
Liang

(10) Patent No.: US 7,159,908 B2
(45) Date of Patent: Jan. 9, 2007

(54) WINDOW SASH LATCH

(75) Inventor: Luke Liang, Irvington, NJ (US)

(73) Assignee: Vision Industries Group, Inc., So. Plainfield, NJ (US)

( * ) Notice: Subject to any disclaimer, the term of this patent is extended or adjusted under 35 U.S.C. 154(b) by 115 days.

(21) Appl. No.: 10/971,566

(22) Filed: Oct. 22, 2004

(65) Prior Publication Data

US 2006/0087130 A1 Apr. 27, 2006

(51) Int. Cl.
*E05C 3/14* (2006.01)

(52) U.S. Cl. ..... 292/242; 292/48; 292/49; 292/52; 292/240; 292/241; 292/DIG. 7; 292/DIG. 20; 292/DIG. 35; 292/DIG. 47; 70/89; 70/90; 49/449

(58) Field of Classification Search ..... 292/242, 292/240, DIG. 7, DIG. 20, DIG. 33, DIG. 35, 292/DIG. 47, DIG. 60, 48, 49, 52; 70/89, 70/90; 49/449
See application file for complete search history.

(56) References Cited

U.S. PATENT DOCUMENTS

| | | | | | |
|---|---|---|---|---|---|
| 192,614 | A * | 7/1877 | Andrews | 292/52 |
| 900,079 | A * | 10/1908 | Bittorf | 292/242 |
| 2,613,526 | A * | 10/1952 | Holmsten | 70/90 |
| 2,884,276 | A * | 4/1959 | Baptist | 292/336 |
| 4,429,910 | A * | 2/1984 | Anderson | 292/199 |
| 4,621,847 | A * | 11/1986 | Paulson et al. | 292/199 |
| 4,801,164 | A * | 1/1989 | Mosch | 292/204 |
| 5,161,839 | A * | 11/1992 | Piltingsrud et al. | 292/241 |
| 5,219,193 | A * | 6/1993 | Piltingsrud | 292/240 |
| 5,741,032 | A * | 4/1998 | Chaput | 292/202 |
| 6,142,541 | A * | 11/2000 | Rotondi | 292/241 |
| 6,588,150 | B1 * | 7/2003 | Wong et al. | 49/183 |
| 6,601,270 | B1 * | 8/2003 | Eckhardt et al. | 16/412 |
| 6,817,142 | B1 * | 11/2004 | Marshik | 49/449 |
| 6,871,886 | B1 * | 3/2005 | Coleman et al. | 292/241 |
| 6,877,784 | B1 * | 4/2005 | Kelley et al. | 292/241 |
| 7,000,957 | B1 * | 2/2006 | Lawrence | 292/241 |
| 7,013,603 | B1 * | 3/2006 | Eenigenburg et al. | 49/185 |
| 7,070,211 | B1 * | 7/2006 | Polowinczak et al. | 292/139 |
| 2001/0005995 | A1 * | 7/2001 | Subliskey | 70/89 |

* cited by examiner

*Primary Examiner*—Brian E. Glessner
*Assistant Examiner*—Carlos Lugo
(74) *Attorney, Agent, or Firm*—Thomas A. O'Rourke; Bodner & O'Rourke, LLP

(57) ABSTRACT

An improved window sash latch which has a locking mechanism and a keeper is provided with a handle that rotates from a "locked" to an "unlocked" position. An inner cavity of the handle has a spring assembly having a sliding part that can be forced into a detent as the handle slides around a cylindrical extension of an outer surface of the latch. The detents correspond to a "locked" and an "unlocked" position of the latch. The latch also provides two cams where both cams revolve relative to each other; one cam is activated by the handle through the handle's shaft, the other cam engages the keeper, and both cams engage each other.

11 Claims, 8 Drawing Sheets

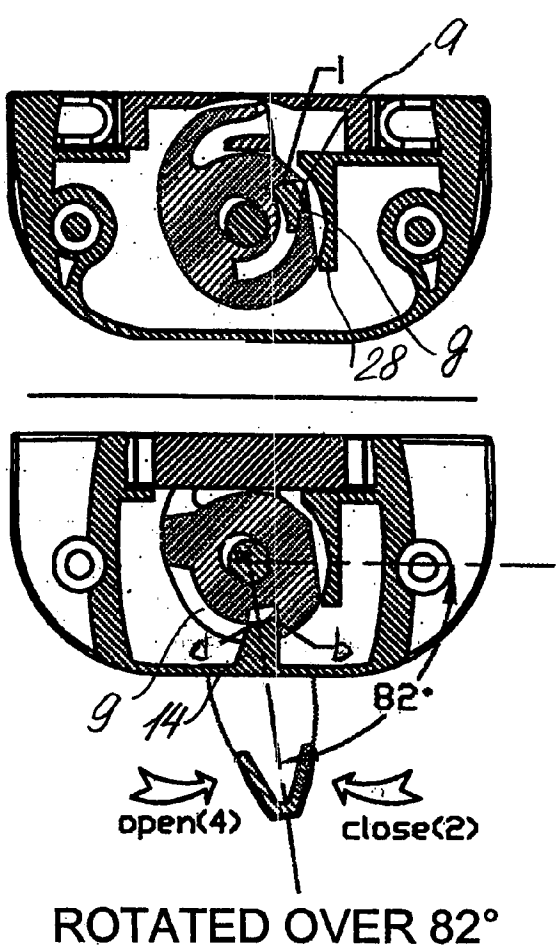
FIG. 15
FIG. 16
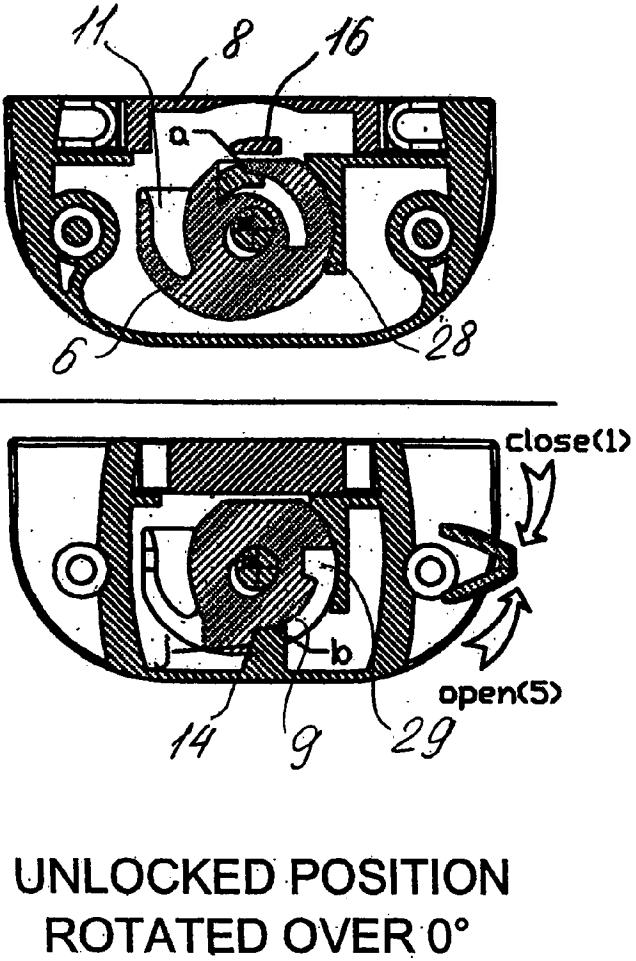
FIG. 13
FIG. 14
H–H
I–I

ROTATED OVER 90°

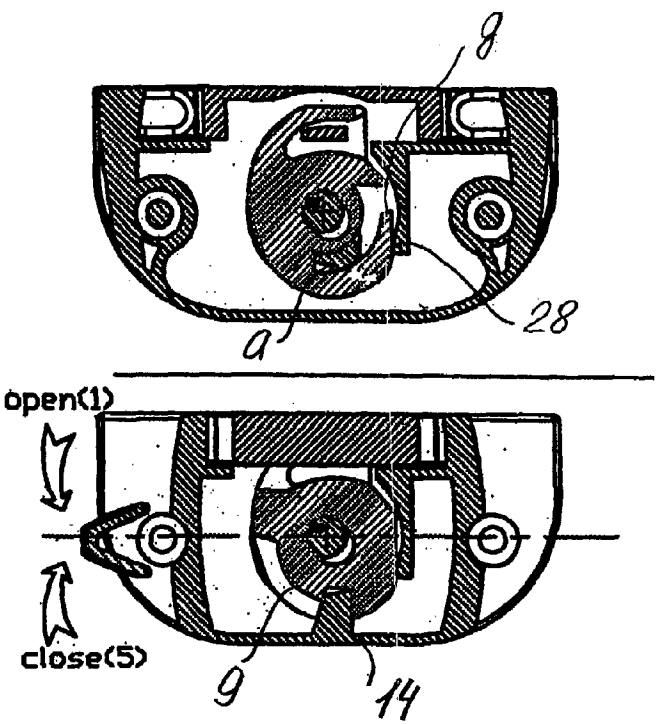
FIG. 21
UNLOCKED POSITION
ROTATED OVER 180°
FIG. 22
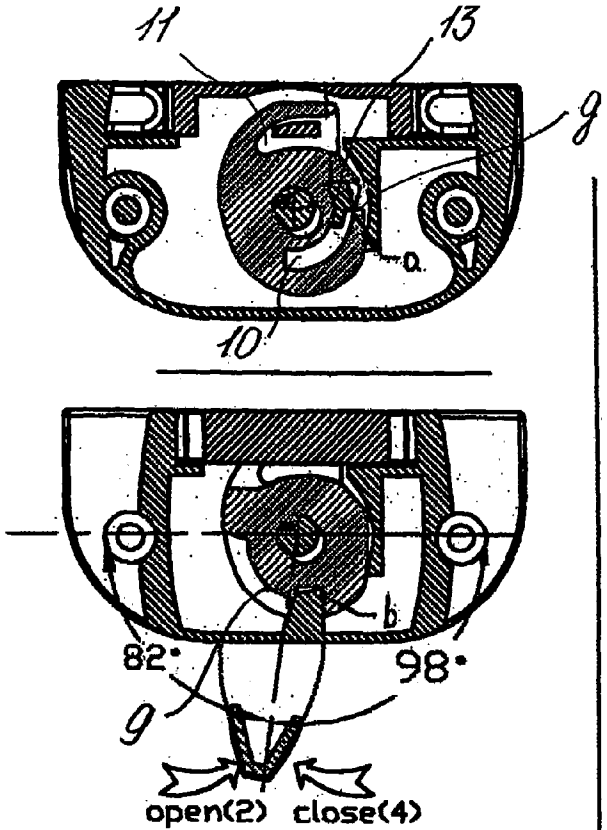
FIG. 19
ROTATED OVER 98°
FIG. 20

WINDOW SASH LATCH

FIELD OF THE INVENTION

The present invention is directed to latches for sliding windows such as double hung windows as well as other types of windows that may pivot around the axis for opening. More specifically, the present invention provides for convenient, resistant to the forced entry, and aesthetically appealing latch that may be maintained on the sash of the sliding windows.

BACKGROUND OF THE INVENTION

Sliding windows such as double hung have won worldwide application for many types of residential and commercial structures, various types of vehicles, boats, flying apparatus, etc. Sliding windows have acquired such a universal popularity in part because they are convenient and save space, they provide easy and suitable access and have many other advantages.

Usually the sliding windows consist of a pair of window sashes, preferably equal in size, each of which moves independently along the parallel tracks that are contained within the inner sides of a single frame that is built into or installed the designated places in the wall. The movement of the sliding windows relative to each other, and both of them relative to the mutual frame on which they are mounted, may be either in horizontal or vertical direction. In order to close such windows, if windows slide in vertical direction, the sash of one window should be pushed upward until it presses against the frame, and the other one pulled downwardly.

The locking function of the sliding windows is provided by the latch which is usually mounted on the sashes of the windows and has two interrelated parts. The location of the latch depends on whether the windows slide in the horizontal or vertical direction relative to each other. If the windows slide in the vertical direction, one portion of the latch is located on the top surface of the lower stile of the upper sash, and the counterpart of the latch is on the top surface of the upper stile of the lower sash. When both windows are closed, both parts of the latch face to each other and are ready to engage. One part of the latch, which may be called the locking member, usually contains a handle which extends outwardly from the window sash. The handle is firmly connected to a cam. The cam has a rounded groove cut to accommodate the key located on the keeper portion of the latch which is affixed to the sash of the second window. The radius of the groove gradually reduces from the beginning of the groove toward the end. Thus, when the handle of the latch is moved from an unlocked to a locked position, the cam starts to wrap around the key of the second window until the key is pressed against the inner wall of the groove. The further key moves into the groove of the cam, the more pressure the key causes to the inner wall of the cam. Eventually, because of such increased pressure, the handle tends to stop in certain position and the latch is locked.

Because of the configuration of the sliding windows, there is a possibility to reach the latch from outside when the windows are closed. Such access provides the opportunity for unwanted breaking into the premises behind the sliding windows. The present invention provides a security and offers to minimize the possibility of such forced entry. The mechanism of the latch is designed in such way that reduces the possibility of opening the latch from the under side of the sashes. The positioning of cams embodied in this invention relative to each other and their configuration makes it difficult for unauthorized person to disengage the locking cam even having access to the latch from underneath the sash lock. In addition, this mechanism may be completely covered by the hood which extends from the outer shell or housing of the latch, providing additional protection against forced unwanted accessibility to the latch. Therefore, it would be advantageous to supply sliding windows with the latches that embody the present invention.

SUMMARY OF THE INVENTION

The present invention relates to a latch for sliding windows. The latch has at least two main parts: a locking mechanism and a keeper. Each counterpart is secured to the sash of either upper or the lower window correspondingly. The locking mechanism is preferably secured to the middle of the top stile of the lower window. The keeper is preferably secured to the middle of the top surface of the bottom of the upper sash.

The locking mechanism portion of the latch may have a handle, a housing, the first and the second cam. The handle of the invention preferably includes the manually graspable portion of the handle, resistance providing member, preferably a conventional spring, a sliding member, and a member that provides restriction to movement of the sliding element. There is also a shaft attached to the handle. The spring with the sliding member positioned on it, is compressed and placed into the inner cavity of the handle in such manner that the sliding member may move back and forth along the line perpendicular to an axis of rotation of the handle. The top portion of the housing of the latch may be formed in a shape of a cylindrical extension with an opening in a center of such extension. The extension generally may have two diametrically opposite notches made on the side surface of the extension. Such notches may be made in order to provide a positive tactile indication that the handle is in the "locked" or "unlocked" position respectively. While the spring, with sliding member positioned on it, remains compressed, the handle may be assembled with the housing in such manner that the end of the sliding member is pressed against the side surface of the cylindrical extension. If the handle is rotated relative to the housing, the end of the sliding member may slide around the side surface of the cylindrical extension remaining pressed against the surface, and may be able to "snap" into the notches made in such extension, providing a positive indication of the handle positioning relative to the housing of the latch. The spring may provide resistance necessary to rotate the handle from the position when sliding member is "snapped" into a detent in order to prevent forced entry as well as accidental and unintentional rotation of the handle.

The present invention may include two cams. The handle preferably includes a pivot shaft coupling the housing of the latch and cams in pivotal relation to each other. Both cams are preferably positioned on the handle shaft and under the housing. The second cam may be configured in such manner that while being rotated around its axis, the cam may engage the keeper, thus locking and unlocking the latch. The second cam may have a groove in order to provide engagement with the keeper. Also, the second cam may have another groove that would mate with the protrusion made on the inner surface of the housing. When the cam engages the protrusion, the cam may not be rotated. Similarly, when the second cam does not engage the protrusion, the cam may be rotated. The second cam and the protrusion may be configured in such way that the second cam could engage with the protrusion and the keeper at the same time.

Both cams may have orifices so that they may be positioned on the shaft of the handle. Because the diameter of the orifice of the second cam may be bigger than the diameter of the shaft upon which the cam is positioned, the rotation of the shaft does not affect the cam. The first cam is preferably positioned underneath the second cam and provides the rotation from the handle to the second cam. The cam that engages the keeper may be configured to shift the axis of its rotation relative to the axis of rotation of the handle shaft. It would allow to such cam not only to rotate around its axis, but also to be shifted in the direction perpendicular to it. It would make it possible for the second cam to disengage with the first cam and to engage with protrusion made on the inner surface of the housing and vise versa. Because of their configuration, when the cams are disengaged, the rotation of the first cam would not affect the cam that engages the keeper. This impermanent engagement of the cams may be provided by the combination of the groove made in the second cam and the protrusion made in the first cam. Because the second cam may not rotate when it engages with the protrusion made in the inner side of the housing, the same cam may not disengage with the keeper. Therefore, the latch would remain locked unless the second cam disengages with the protrusion on the housing. In such configuration, rotation of the handle would rotate the first cam. At some point, the second cam would be released from the engagement with the protrusion made in the housing, and then the first cam may engage the second cam and both may rotate thus disengaging the second cam and the keeper and unlocking the latch.

BRIEF DESCRIPTION OF THE DRAWINGS

FIG. 13 is a top cut-away view of the latch with attached keeper taken along the line H—H showed in FIG. 7. The latch is in the "unlocked" position; the handle of the latch is in the "open" position. Attendant FIG. 14 is a top cut-away view of the latch with attached keeper taken along the line I—I showed in FIG. 7. The latch is in the "unlocked" position; the handle of the latch is in the "open" position.

FIG. 15 is a top cut-away view of the latch in operable position with attached keeper taken along the line H—H showed in FIG. 7. The latch changes position from "unlocked" to "locked"; the handle of the latch is rotated at less than 90 but more than 75 degrees from the "opened" position.

FIG. 16 is a top cut-away view of the latch in operable position with attached keeper taken along the line I—I showed in FIG. 7. The latch changes position from "unlocked" to "locked"; the handle of the latch is rotated at less than 90 but more than 75 degrees from the "opened" position.

FIG. 19 is a top cut-away view of the latch in operable position with attached keeper taken along the line H—H showed in FIG. 7. The latch changes position from intermediary to "locked"; the handle of the latch is rotated at approximately more than 90 but less than 115 degrees from the "open" position.

FIG. 20 is a top cut-away view of the latch in operable position with attached keeper taken along the line I—I showed in FIG. 7. The latch changes position from intermediary to "locked"; the handle of the latch is rotated at approximately more than 90 but less than 115 degrees from the "open" position.

FIG. 21 is a top cut-away view of the latch in operable position with attached keeper taken along the line H—H showed in FIG. 7. The latch is in the "locked" position; the handle of the latch is rotated at approximately 180 degrees from the "open" position.

FIG. 22 is a top cut-away view of the latch in operable position with attached keeper taken along the line I—I showed in FIG. 7. The latch is in the "locked" position; the handle of the latch is rotated at approximately 180 degrees from the "open" position.

DETAILED DESCRIPTION OF THE PREFERRED EMBODIMENTS

Figure 2:
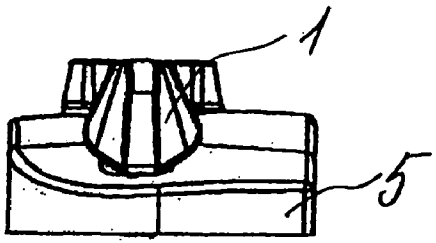
FIG. 2 is front view of the assembled latch.
Figure 4:
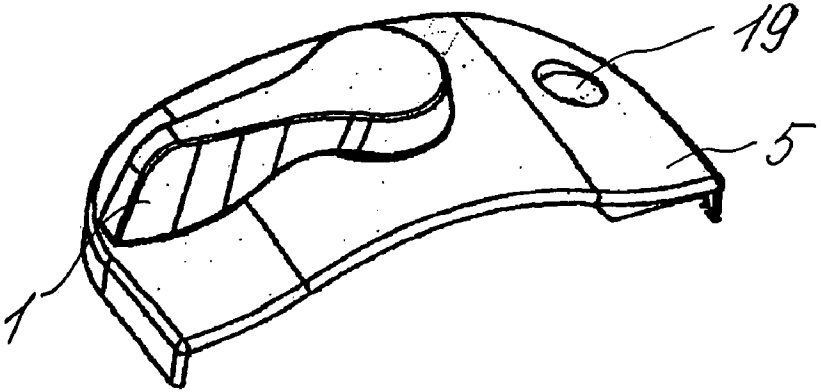
FIG. 4 is prospective side view of the latch mechanism.

In one embodiment of the present invention there is generally a handle 1, a spring 2, a bar 3, a plate 4, a housing 5, a first cam 6, a delay cam 7 and a keeper 8.

The housing 5 may generally be any suitable shape. In one embodiment the housing may be rectangular in shape with preferably two square corners on the side of the sash lock that is closest to the keeper 8, and on the opposite side of the housing there may be two rounded or squared corners depending of the "look" or style of the sash lock. Viewing the sash lock from the side having the squared corners, the housing has an open cavity which for example, may resemble an arch or raised portion. Residing in the cavity are the first cam 6 and the delay cam 7 which are preferably covered by the housing. Housing 5 may be provided with two screw holes 19 to mount the latch to the window sash.

Underneath these holes the housing may have two pillars 20 that have such length that when latch is placed on a flat surface, the bottom of each pillar would generally touch the surface. Both pillars may serve to reinforce the housing's resistance to the possible deformation and prevent tension between moving parts of the latch when they rotate relative to each other. Such tension may emerge due to existence of the force upon the housing when screws that attach housing to the window sash are tightened. The pillars 20 may, for example, have an oval shape although other shapes are possible. The screw holes for mounting of the housing to the window sash may be drilled through such pillars for aesthetic and reinforcement purposes, although other placements for holes are possible.

The present invention combines simplicity and convenience to use the window latch. For example, it is preferable that the handle 1 of the latch has an ergonomic shape. To provide a convenient grip, the handle's grasping area may, for example, be generally trapezoidal with wider bottom and narrower top if the handle is viewed from the front, and if viewed from the top, the same handle may be relatively wide at the end, becoming narrower toward the middle, forming a "neck", and than getting wider again. The handle of such shape would be very convenient to operate. The curves and corners, lengths and widths of different parts of the handle may vary to achieve the best result.

Next, in order to secure the position of the handle of the invention as either "locked" or "opened," and at the same time to provide the user of the invention with the resistive tactile feeling that corresponds such positions of the latch, the lock may employ a variety of possible embodiment of such features. In one example, the handle 1, connected with the locking mechanism, may rotate around its axis, preferably about 180 degrees, and while rotating, the handle should be able to "snap" into such designated positions as to indicate for the user that the latch is locked or opened and also to prevent forced entry when in the locked position. In this embodiment, as a part of the housing 5, there may be a ring or an extension 17 on the top surface of the outer shell of said housing. The ring may be in the shape of a cylinder or a cone with low profile or height above the surface of the housing. The ring may be integral with the housing or may be a separate member. On the side surface of said extension there may be two detents or notches that would designate the locking position of the latch, although such extension and detents may have different configuration to serve the same functions. Alternatively, there may be slight protrusions on the ring that can accomplish the same purpose. This extension of the housing may have an opening, preferably round and in the middle, through which the shaft of the handle 1 is passed through and within which such shaft may freely rotate. In a preferred embodiment, the extension 17 may also have two diametrically opposite V-shaped notches 18 on the side surface of said extension 17 that extend from the upper surface of the ring to the bottom surface of the ring along the length of the sidewall.

The handle 1 may have a shaft which passes through the housing from the outer side of the extension 17, then through the first cam 6, then through the delay cam 7. In a preferred embodiment, the handle has a cavity such as a cavity having a trapezoidal cross section underneath the upper surface of the handle that accommodates the spring 2, the bar 3 and the plate 4.

Figure 6:
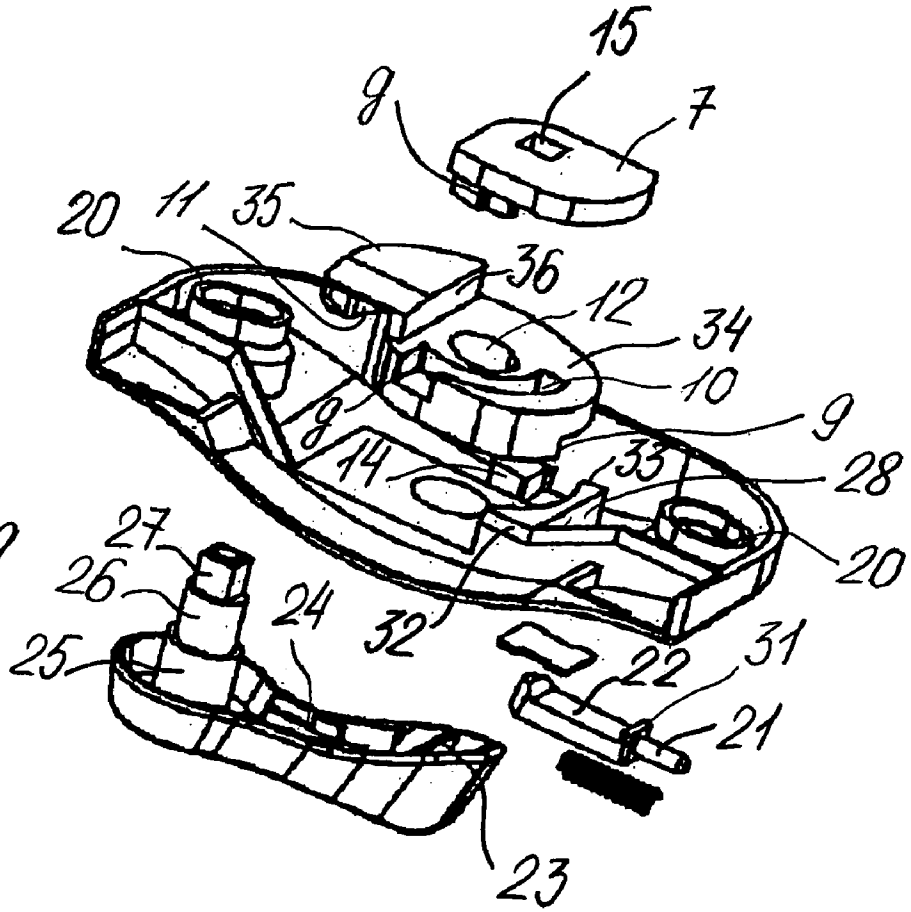
FIG. 6 is a prospective upside down exploded fragmentary view of the latch showing all components of the latch separated from each other.

As was mentioned above, notches may be made in order to provide a positive tactile indication that the handle is in the "locked" or "unlocked" position respectively. In a preferred embodiment, the bar 3 may be positioned so that the compressed spring 2, and the bar 3 are within the cavity of the handle with the spring located at the side of the handle opposite the end connected to the shaft. If the handle in present configuration is then positioned on the housing, the movement of the spring would thrust the bar forward toward the side of the extension 17. That would allow the bar to contact the side surface of the extension 17 when the handle revolves around its axis relative to the housing, and to be able to "snap" into designated notches 18. The position of the handle, when the bar is "snapped" into the notch, would correspond to an "opened" or "locked" position of the latch. The notches would be preferably V-shaped indentations, or detents, or cuts, or recesses of a similar shape made in the side surface of the extension 17 such as a U-shaped recess, etc. Similarly, the corresponding end 22 of the bar that would "snap" into such notches would be preferably a shape corresponding to the shape of the recess so that the bar and recess mate. As seen in FIG. 6, the corresponding end 22 of the bar 3 is generally V-shaped to correspond to the shape of the notches in the extension 17 Such shape of the notch and the corresponding to it counterpart of the bar may be dictated, on the one hand, by the compromise between the necessity of the relatively effortless rotation of the handle from the position when the bar is "snapped" into the notch, and some resistance, supplied by the spring 2, which is essential in order to prevent forced entry as well as an accidental and unintentional rotation of the handle.

The housing 5 of the latch may have protrusion 28 positioned on the inner side of the top surface of the housing. The protrusion 28 has a first end 32 and a second end 33 and slopes upwardly from the first end 32 to the second end 33. The purpose of the protrusion is to prevent the movement of the cam 6 relative to the housing and in order to keep the cam 6 engaged by delay cam 7. As depicted in FIG. 6 and 13, because the protrusion 28 may contact the side surface of the cam 6, one side of such protrusion may be rounded to resemble the side surface of the cam 6 in order to better accommodate the contact. More detailed description and functioning of the protrusion 28 is provided below.

In order for the bar 3 to "snap" into the notches made on the side surface of the extension 17, the tip 22 of the bar should slide around the extension 17 as the handle is turned, while generally remaining pressed against the side surface of the latter. Such pressure may be supplied by the spring 2 or any similar device that may function in the similar way and provide thrust to the bar. Positioned on the stem 21 of the bar and compressed, the spring 2 would thrust the bar toward to and press it against the extension 17. Therefore, in order for the bar 3 to be pressed against the side of the extension, the bar should preferably have such configuration that when coupled with spring 2, the latter, while remain compressed, thrust the bar 3 to engage with extension 17.

To couple the spring 2 and the bar 3 various combinations may be used. For example, the bar may have a blind bore on its end and the spring is positioned within the bore. Or, for example, like in the present embodiment, the bar or the stem 21 of it may be positioned within the spring. In order to avoid the disfigurement of the spring and provide the evenly distributed compression when the spring is positioned on the bar and then compressed, the cross section of the bar should preferably have generally the same shape as the cross-section of the spring. Thus, with the purpose to accommodate the spring, the embodiment shown in the figures has the bar that generally has a cross-section that resembles the cross-section of the spring. In order for the spring, if compressed and positioned on the bar, to move jam-free, the diameter of cross-section of the spring generally should be somewhat wider that the diameter of the cross-section of the counterpart of the bar. It will be appreciated by one skilled in the art that the cross-section of the stem 21 can be any cross-section that supports the spring. Similarly, if a recess is used in the bar its cross-section may be any configuration as long as it receives and retains the spring. One possible variation of such shape of the bar is a cylinder of smaller diameter than the diameter of the spring positioned on it. Therefore, at least one part of the bar that would bear a spring may have a shape of cylinder.

Figure 1:
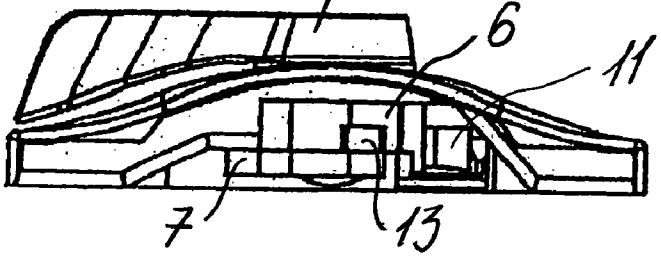
FIG. 1 is a side view of the assembled latch mechanism without keeper.
Figure 3:
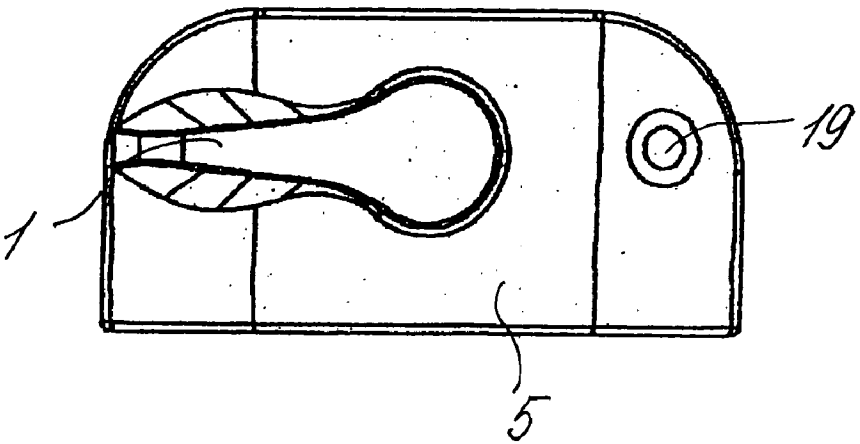
FIG. 3 is an alternative side view of the latch.

As was shown, the bar may embody different configurations in order to accommodate the spring and to prevent the spring from sliding outwardly from the bar if such spring should be compressed. Moreover, because the present embodiment may have a bar that engages the housing extension 17, and therefore, may contact the surface of the side of such extension, at least one end of such bar should bear no spring positioned on it. One possible solution is to make extensions somewhere on the body of the bar that would prevent the spring, once positioned on the bar, from sliding further if such spring is compressed. Except that width of the cross-section of such bar at the place where such extensions expand from the bar should be bigger than the cross-section of the spring in order to prevent sliding of such spring, the shape of the extensions may vary. Another solution is to make a stepped shoulder 31, as seen in FIG. 1, on the bar that shows an increase in diameter or width in cross-section. Such shoulder would prevent the spring from sliding along the bar when spring is compressed. Therefore, while one portion of the bar that accommodates the spring may be preferably cylindrical, the other portion of the bar may have any shape provided though that the portion of the bar that is not intended to bear the spring is guarded by either extensions or stepped shoulder of wider diameter or by any other change in shape of the bar, to prevent spring, once positioned on the presumably cylindrical end of the bar, from sliding toward the other end if such spring is compressed.

This embodiment may have a bar that has two portions 21 and 22. One portion 21 would accommodate the spring. The end of the other portion or body 22 would be pressed against the side of the extension or rim 17. Both portions may be separated by the end plate that would prevent the spring, once positioned on one end of the bar and compressed thereafter, from sliding toward the other end, and therefore, thrust the bar toward the extension 17.

As was indicated, one portion of the bar, i.e. the stem 21 may be generally cylindrical. The other portion of the body may have any shape, but because the bar with the spring positioned on it may be embodied in the handle in such way that the bar contacts the side surface of the extension 17 of the housing, the shape and the size of the second or body portion of the bar 22 may be required to fit the space provided within the trapezoid inner cavity of the handle. Because the handle of the invention may preferably remain as smaller as possible for the purposes of convenience and aesthetical demands, the configuration of the inner cavity would determine possible shapes and sizes of the bar.

The desirable thrust may be achieved by the compression of the spring between at least two surfaces. One such surface may be formed by the end plate or surface that divide the bar 3 as was shown above. The second surface may be formed by partition 23 that may be, for example, an integrated part of the inner cavity of the handle. The partition may be generally perpendicular to the handle and aligned along the inner cavity in order to better secure the compressed spring in such cavity of the handle and to prevent the spring-bar assembly from dislocation in vertical and horizontal direction. The partition may vary in shape in order to better secure the positioning of the spring. For example, the partition may have an extension that may extend toward the spring, and upon which the spring is positioned. The location of the partition within the cavity of the handle may be determined by the length of the bar with the compressed spring positioned on it. Because the bar contacts the side surface of the extension 17, the partition may be situated within the cavity in such manner that when bar-spring assembly with compressed spring is embodied in the cavity and pressed against the partition, the spring provide sufficient resistance to thrust to the bar toward the extension 17 and to press it against the side surface of said extension. However, the length of the bar and the spring may be also regulated in order to achieve desirable resistance to the rotation of the handle.

To prevent the spring or the bar within the cavity of the handle from falling down from the cavity, a plate 4 may be positioned over the cavity of the handle or a portion thereof to support such assembly. The configuration of such plate and the method by which the plate is secured in the cavity of the handle may vary. Present invention, for example, may use the plate rectangular with low profile. Because the handle may be trapezoid in cross-section, the friction created between thus inclined side walls of the handle and the plate may hold the plate 4 in place when such plate is positioned horizontally into the cavity and then firmly pressed. In addition, there may be two protrusions 24 positioned in the opposite sides of the wall of the "neck" of the handle's cavity. These protrusions may form a space to accommodate the portion 22 of the bar 3. If desired, a friction fit between the bar and the protrusions because the body portion 22 of the bar 3 may move slightly back and forth when the bar "snaps" into and disengages the detents made into the side surface of the extension 17, these protrusions may allow to such bar to move along the handle with reduced probability of being jammed or dislocated. Because distance flanked by protrusions 24, between which the bar may be positioned, may be slightly wider than the width of the bar 3, the latter may move along the handle without undue friction with said protrusions.

The handle's shaft may have three different portions 25, 26 and 27, along to the length of the shaft, as depicted in FIG. 6. First portion 25 of the shaft may have a cylindrical shape. It may begin from the top where the handle attaches to the shaft, and then continue downwardly for approximately the height of the cylindrical extension 17. The diameter of the cross-section of the shaft at the first portion 25 is preferably slightly less than the diameter of the rounded opening made in the extension 17. Such configuration of this portion of the shaft is desirable in order to secure the revolving movement of the shaft within the opening of the extension 17 without undue friction between the shaft and such opening, and at the same time to minimize angular misalignment of the shaft relative to the housing. Then, approximately at the point where the handle's shaft reaches the cam 6 that is positioned next to the housing, the configuration of the shaft may be in a form of a cylinder. Because this portion 26 of the shaft may be positioned through and revolve without undue friction within the opening made in the cam 6, the cross-section of such portion of the shaft is preferably smaller than the size of said opening in order for the shaft to revolve without undue friction within the opening 12. The length of the portion 26 is preferably about the height of the cam 6. At that point, the configuration of the shaft preferably changes from a cylinder to a generally rectangular portion 27 which may be square in cross-section in order to accommodate the square traverse opening made in the delay cam 7. Such configuration of the shaft and corresponding opening 15 in the delay cam 7 may be chosen in order to provide firm connection of said shaft with the delay cam although other configurations may be used. Therefore, the lower portion 27 of the shaft is preferably to fit the traverse opening 15 in the delay cam 7 thus allowing firm connection between the handle 1 and the delay cam 7; the rotation of the former would causes the rotation of the latter.

While the handle shaft is passed through the housing 5, the cam 6 and the delay cam 7, the end of the shaft opposite to the handle end of the shaft may be provided with a head to keep the handle 1, the housing 5, the cam 6 and the delay cam 7 on the same rotation axis in the preferably following order: the shaft is first positioned through the traverse round opening on the housing 5, then the shaft is passed through the traverse opening 12 in the cam 6, then the shaft is passed through the square traverse opening 15 in the delay cam 7 and then the head is formed at the end of the shaft.

The present invention may have a cam 6. This cam may serve three different purposes at the same time: it may engage the key 16 of the keeper 8 in order to lock and unlock the latch, it may engage the protrusion 14 on the housing 1 in order to prevent rotation of said cam, and it may engage the delay cam 7 which protects the cam 6 so that an intruder will not be able to access the cam 6. In order to be able to perform all these functions, the configuration employed by the present invention of the cam 6 may preferably resemble rectangular with rounded corners, its height/width ratio may vary to fit the dimensions of the housing in order to be accommodated by the latter, the length of the shaft and the position of the keeper. The cam 6 has preferably two sections 34 and 35. The cam 6 also may have one or more grooves or slots cut out in order to engage the keeper 8, the delay cam 7 and protrusion 14. The deeper the engagement of the protrusion 14 and the keeper 8 with the corresponding grooves made in the cam 6, the better the latch performs its locking function. Therefore, the grooves made in the cam 6 are preferably deep enough in order to provide better locking function; each groove may preferably occupy the segment of the cam as large as the dimensions and configuration of the cam 6 would allow. In order to do that and at the same time to minimize the size of the cam to facilitate accommodation of said cam 6 under the housing, and thus to fit the relatively narrow, as many conventional sliding windows have, width of the stile of the window, and to be able for such cam to engage with the keeper 8 and protrusion 14, it is preferable to cut grooves that engage the keeper 8 and the protrusion 14 in the different sections of the cam 6. Thus, the cam 6 may have several sections.

The preferred embodiment may have two sections. Sections 34 and 35 may be separated by a step 36 formed by surfaces that form about a 90 degrees angle. Section 34 may be designed to mate the cam 6 with the delay cam 7. Section 34 may have two grooves: the groove 9 may be cut on the side of the cam 6 and such groove may be adjacent to the inner side of the housing 5 to accommodate protrusion 14. The groove 9 preferably has a square cross section and it cut one quarter of the way around the cam 6. The housing 5 may have a protrusion 14 which may be positioned approximately in the middle of the inner side of the wall of the housing; it may be trapezoidal or rectangular in shape. The cam 6 and the protrusion 14 are configured in such way that when the cam rotates, the protrusion may restrict such rotation. The rotation restriction can prevent the excessive pressure from being applied to the protrusion 14 of the housing 5 and/or to the key 16 of the keeper 8 by the cam 6 when such cam contacts with the protrusion 14 and to provide engagement-disengagement of the cam 6 and delay cam 7.

In order to secure the "locked" position of the latch and to prevent forced entry, the cam 6 may be configured in such way that when the cam 6 rotates toward the "locked" position, the groove 11 engages the keeper 8. At the same time the cam 6 rotates relative to the protrusion 14 from one side of the groove to the other side. Then, when protrusion reaches the end of the groove, it would be desirable if the cam 6 is prevented from rotation back unless the handle of the latch is turned back to the "opened" position. Such configuration would be advantageous because it would not allow turning the cam 6 back to the "unlocked" position by a person having access underneath and outside the latch, a place from which forced entry may be attempted. Therefore, it is preferable if the groove 9 at the end that corresponds to the "locked" position of the latch would be followed by the groove 29 positioned at the angle approximately perpendicular to the groove 9. This groove 29 may be configured to accommodate the protrusion 14. The oblong opening 12 in the cam 6 would allow the cam to shift toward the protrusion 14 to position such protrusion within the groove. In that configuration, in order to rotate the cam 6 back to the "opened" position, the protrusion 14 has first to be disengaged from the groove 29 by shifting the cam in the direction perpendicular to its rotation axis, and then, to be rotated back in order to unlock the latch.

The groove 10 may be formed on the section 34 of the cam 6. Such groove may mate with the protrusion 13 of the delay cam 7. The groove 10 on the cam 6 may have a square cross section and may be cut one quarter of the way around. This groove is cut on the part 35 of the cam 6 on its underside, as depicted in FIG. 6.

Figure 5:
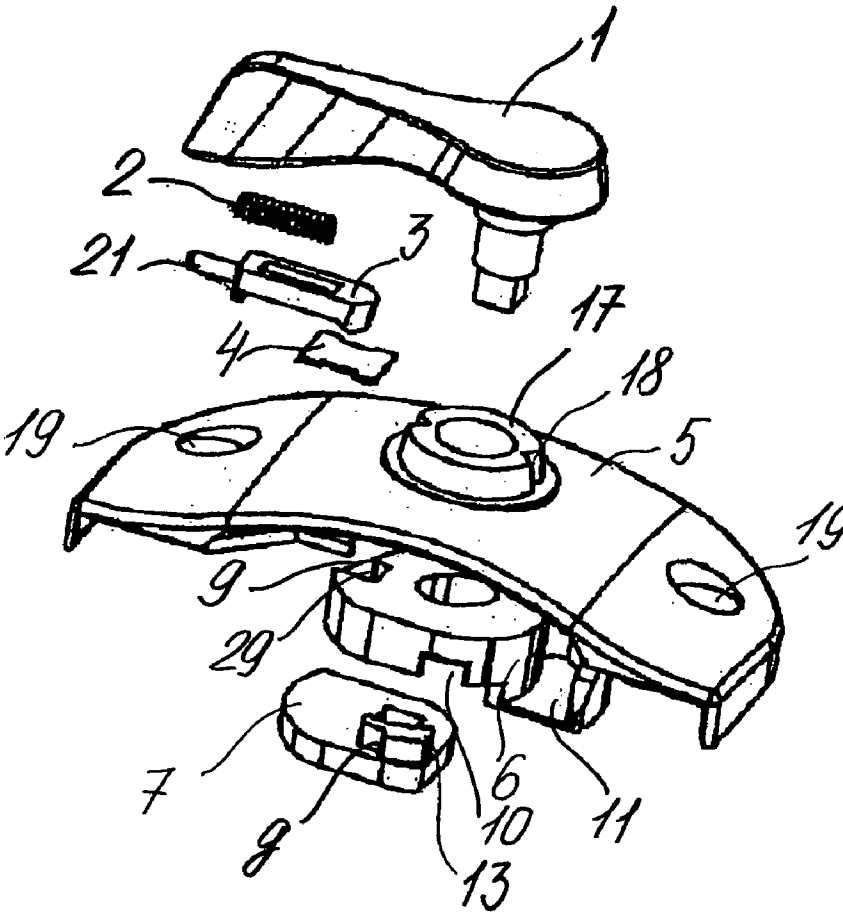
FIG. 5 is an exploded fragmentary prospective side view of the latch mechanism of the present invention without the attached keeper.
Figure 10:
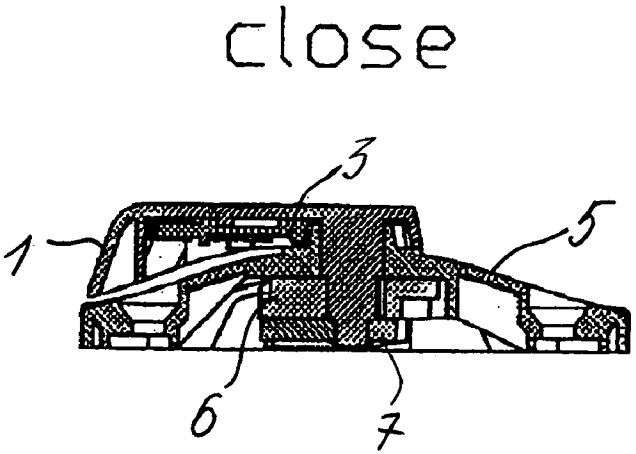
FIG. 10 shows a cut-away side view of the latch in the closed or locked position without attached keeper.
Figure 7:
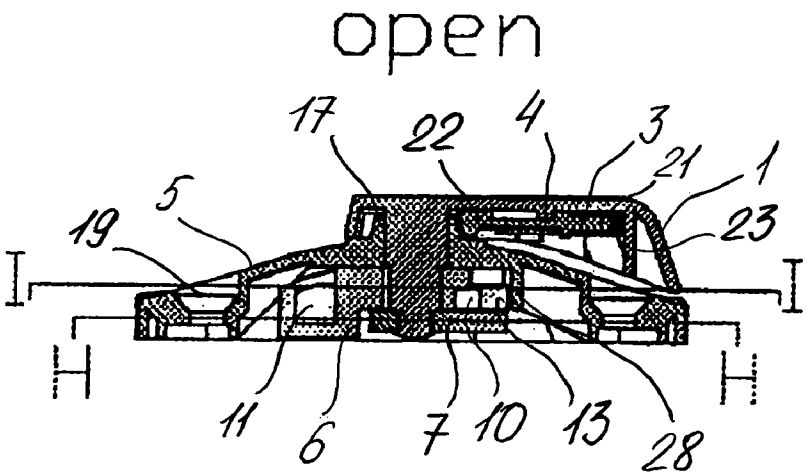
FIG. 7 shows a cut-away side view of the latch in the opened position.
Figure 11:
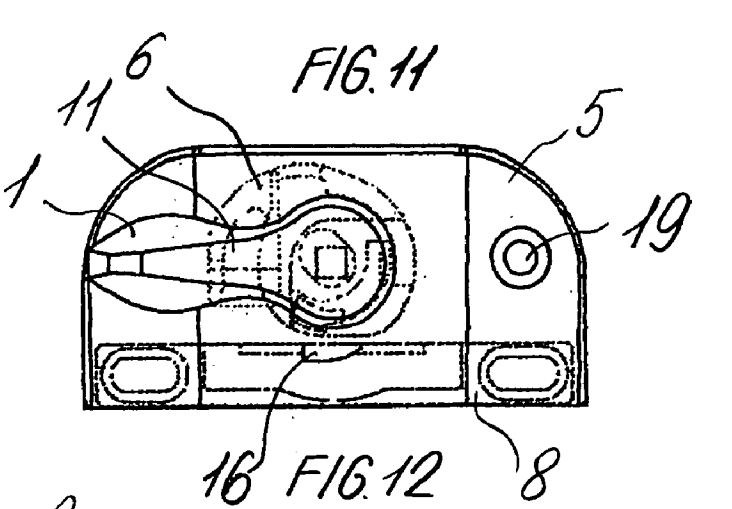
FIG. 11 shows the latch from the top, the latch is manufactured with the hood, in the opened position.
Figure 12:
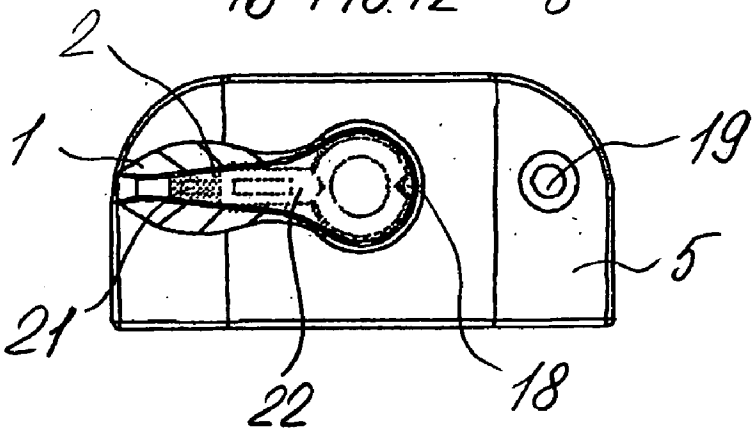
FIG. 12 shows the latch of FIG. 11 with projection showing the keeper attached to the latch in a locking position.
Figure 8:
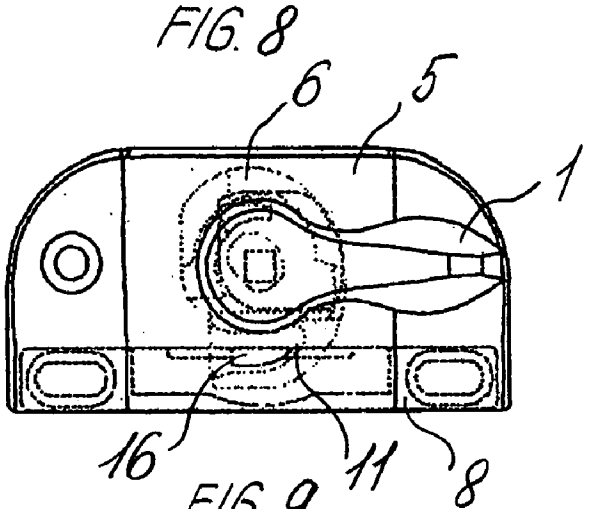
FIG. 8 shows the latch from the top, the latch is manufactured with the hood, in the locked position.
Figure 9:
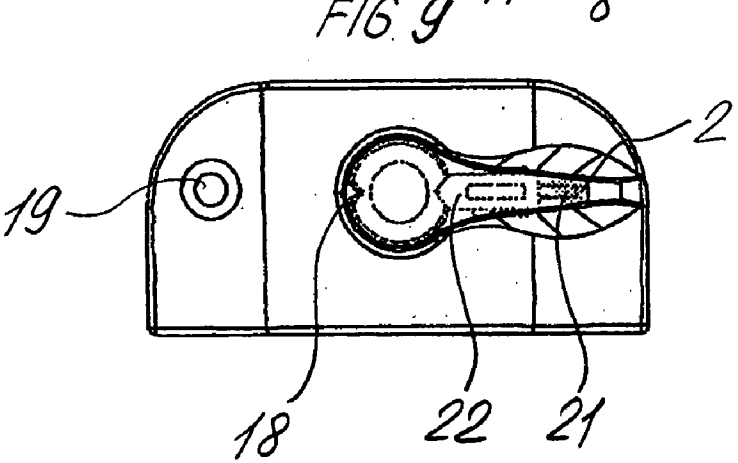
FIG. 9 shows the latch of FIG. 8 with projection showing the keeper under the housing of the latch.
Figure 17:
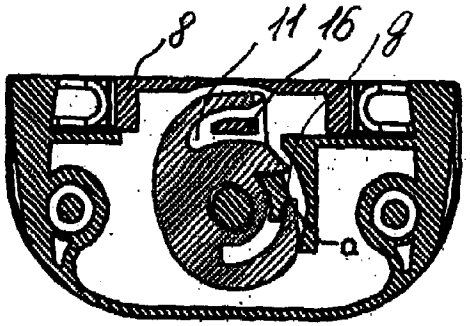
FIG. 17 is a top cut-away view of the latch in operable position with attached keeper taken along the line H—H showed in FIG. 7. The latch is in the intermediate position from "unlocked" to "locked"; the handle of the latch is rotated at approximately 90 degrees from the "open" position.

The delay cam 7 preferably is generally rectangular in shape. Three of the corners of the generally rectangular delay cam may be rounded. The delay cam may have a square opening 15 on its surface. The square end 27 of the handle's shaft may be inserted into the square opening of the delay cam 7, and the rotation of said delay cam 7 may be caused by the rotation of the handle 1. The delay cam may have a protrusion 13 which mates with groove 10 in the cam 6, as depicted in FIG. 5. This protrusion 13 may be generally rectangular and have a cut out step formed by a step surface a which functions to engage surface g of the cam 6 and thus to rotate cam 6, as depicted in FIGS. 13, 17 and 19.

When the latch is in unlocked position, the end of the bar 3 is snapped into the detent 18 made into the side surface of the extension 17 of the handle 1. When the handle 1 is moved from "unlocked" to "locked" position by the rotation of the handle, the end of the bar 3 disengages the detent on the extension 17 that correspond the "unlocked" position of the latch and begins to slide around the side surface of the extension 17. At the same time, the rotation of the handle affects the delay cam because of the firm connection of such delay cam 7 and the handle. Thus, when the handle is rotated from the "unlocked" toward the "locked" position, the delay cam 7 engages the cam 6 in the following way: the protrusion 13 of the delay cam 7 may have a surface a, when the handle is in the "unlocked" position, the configuration of the delay cam 7, cam 6 and their mutual position may be such that a surface a is pressed against the surface g of the entry of the groove 10 of the cam 6, as depicted in FIG. 13. The protrusion 13 and the corresponding groove 10 may be configured in such way that the surface a of the protrusion 13 that actually engages the surface g of the entry of the groove 10 of the cam 6, may be relatively small in order to disengage the surface a of the protrusion 13 with the delay cam 7 if the cam 6 faces the resistance to the further rotation. The ability of the cam 6 to disengage the cam 7 would allow the cam 6 to shift toward the protrusion 14 in order to engage it and thus to prevent cam 6 from rotation back and therefore, to unlock the latch, unless the cam 6 is released from such engagement.

Figure 18:
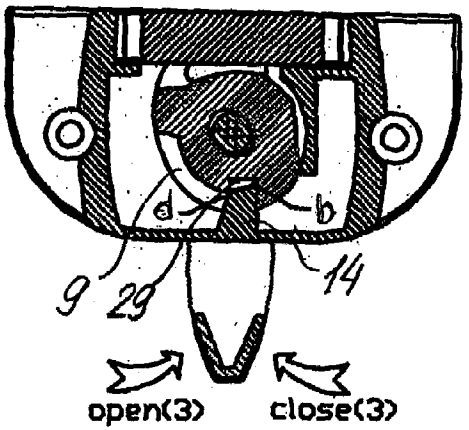
FIG. 18 is a top cut-away view of the latch in operable position with attached keeper taken along the line I—I showed in FIG. 7. The latch is in the intermediate position from "unlocked" to "locked"; the handle of the latch is rotated at approximately 90 degrees from the "open" position.
Figure 23:
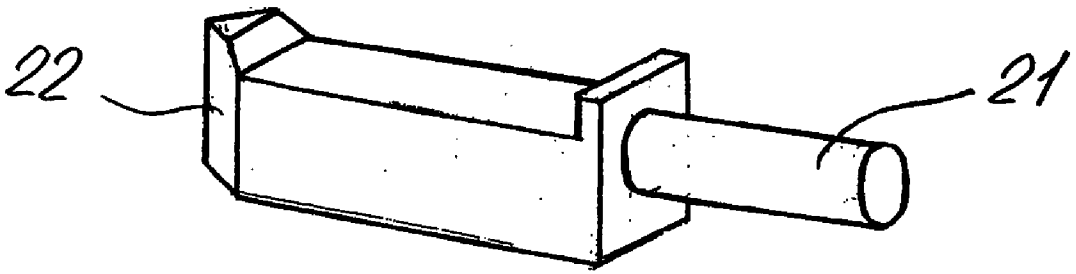
FIG. 23 shows a prospective view of the sliding bar located in the inside slot of the handle.
Figure 24:
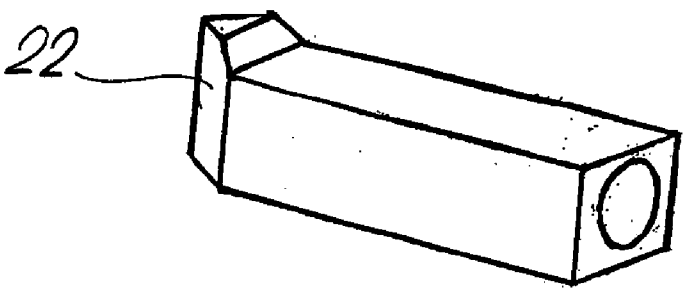
FIG. 24 shows an alternative embodiment of the sliding bar.

In the present invention, the cam 6 does not have a firm connection with the shaft of the handle, thus the rotation of the shaft does not affect directly the cam 6. When the handle is rotated from the "unlocked" to the "locked" position, the delay cam 7 begins the rotation, therefore, the protrusion 13 of the delay cam 7 engages the cam 6 by pushing the cam 6 to rotate around its axis as shown in FIG. 13. At the same time, when the cam 6 begins its rotation, the curved side of the protrusion 28 slides around side surface of the cam 6, as depicted in FIG. 13. Although the stretched traverse opening made in the cam 6 allows the cam to shift while being positioned on the handle's shift, the configuration of the cam 6 and the protrusion 28 prevents the former from shifting until the handle of the latch is rotated for approximately half-way. As long as the cam 6 may not shift its position relative to the delay cam 7 and housing 5, the cam would be engage by the delay cam 7 to rotate, as shown in FIG. 15. As depicted in FIGS. 14 and 16, the rotation angle of the cam 6 is limited by the protrusion 14. When surface b of protrusion 14 meets the surface d of the groove 9 of the cam 6, the cam 6 could not rotate anymore, as depicted in FIG. 16. If the handle of the latch continues rotation from the "unlocked" to the "locked" position, the delay cam 7 continues to rotate. Because the cam 6 may not rotate any further, and because the surface a of the delay cam continues to press against the outer surface of the entry of the groove 10 of the cam 6, the protrusion 13 disengages the surface g of the entry of the groove 10 and slips into the groove 10, as depicted in FIG. 17. While the cam 6 still rotates, the groove 11 of the cam 6 engages the key 16 of the keeper 8, locking the latch, as depicted in FIG. 15. The cam 6 stops its rotation at this point. Further rotation of the handle causes the protrusion to move deeper into the groove 10 as shown in FIG. 18. Because the radius of the groove 10 gradually reduces, and because of the ability of the cam 6 to shift, the protrusion 13, moving within the groove 10, begins to push the cam 6, shifting it toward the groove 29 until protrusion 14 engages the groove 29. As shown in FIGS. 15 and 17, because of the configuration of the cam 6, the curved side of the protrusion 28 does not meet the side surface of the cam 6 at this point, and thus, does not prevent the cam 6 from shifting. As depicted in FIGS. 19 and 20, the surface a of the protrusion 13 is disengaged the entry surface of the groove 10 of the cam 6, and outer surface of the protrusion 13 begins to slide along the groove 10. As depicted in FIGS. 21 and 22, when the handle of the latch is turned to the position "closed," the protrusion 14 is positioned within groove 29. In that position, in order to open the latch, the protrusion 14 must be disengaged with groove 29 before the cam 6 may be rotated back in order to disengage key 16 and groove 11 of the cam 6. Because it would be difficult to disengage the protrusion 14 and groove 29 from outside and underneath of the window, forced entry would be prevented.

The keeper 8 may be any type well known in the art. In one embodiment, the keeper may be rectangular in shape; it may have two holes to connect the keeper to the sash of the window. The keeper preferably has a low profile that allows it to fit inside the hood of the housing if the housing is provided with such a hood. Regardless whether the housing 5 has a hood, the shape of the keeper 8 preferably resembles the housing's profile but it is not required to do so. One side of the keeper, adjacent to the latch, has an opened arch with protrusion 16 on the top of it. The protrusion may be, for example, trapezoid in shape and located approximately in the middle of the arch. The shape of the keeper forms the cavity in the inner side of the keeper providing space for accommodation of the section 35 of the cam 6; the groove 11 of the cam 6 may engage protrusion 16 of the keeper, thus providing locking function. As depicted in FIG. 13, the radius of the groove 11 gradually decreases from the beginning of the groove toward the end. When the groove 11 of the cam 6 engages with the protrusion 16 of the keeper, as shown in FIG. 15, the protrusion 16 begins moving within the groove 11.

Although only one embodiment of this invention has been in details described above, those skilled in the art will readily appreciate that many modifications of the exemplary embodiment are possible without materially departing from the novel teachings and advantages of this invention. For example, various configuration of the sliding window latch may be used to provide the resistance to the forced entry. Alternative mechanisms may provide for the coupling of various parts of the latch, different types of the engagement between cams and delay cams, between cams and keepers, or for the movement of the handle from the first ("locked" or "unlocked") position or second position. Furthermore, alternative shapes and configuration may be used for housing and keeper. All such variations and modifications intended to be included within the scope if this invention as defined in the following claims.

Other modifications, substitutions, omissions and changes may be made in the design, size, materials used or proportions, operating conditions, arrangement or positioning of elements and members of the preferred embodiment without departing from the spirit of this invention as described in the following claims.

What is claimed is:

1. A window latch securable to a window sash that provides a locking function to at least one sliding sash, comprising: a housing having an orifice thereon, a handle with a manually graspable portion, said handle having a shaft extending from said handle through said orifice in said housing, said shaft being secured to a locking mechanism, said locking mechanism comprising a first cam secured to said shaft, and a second cam said second cam having an orifice, said shaft passing through said orifice, said second cam being in contact with said first cam, and wherein when said locking mechanism is in an unlocked position, said first cam is adapted to rotate from a first locking mechanism position to a second locking mechanism position while rotating said second cam and said first cam being adapted to rotate from said second locking mechanism position to a third locking mechanism position without driving said second cam, and wherein when said locking mechanism is in a locked position said first cam is adapted to rotate from said third locking mechanism position to said second locking mechanism position without rotating said second cam, said first cam being adapted to drive said second cam from said second locking mechanism position to said first locking mechanism position when said first cam is rotated from said second position to a third position.

2. The latch according to claim 1 wherein said second cam has a groove in the surface of said second cam that receives a pin on said first cam said pin being adapted to engage the said second cam when said first cam rotates from said first locking mechanism position to said second locking mechanism position when said locking mechanism is unlocked.

3. The latch according to claim 2 wherein said pin does not engage said second cam when said first cam rotates from said second locking mechanism position to said third locking mechanism position.

4. The latch according to claim 3 wherein when said locking mechanism is in a locked position said pin is adapted to travel in said groove without engaging said second cam when said first cam rotates from said third locking mechanism position to said second locking mechanism position and said pin engages said second cam when said first cam moves from said second locking mechanism position to said first locking mechanism position.

5. The latch according to claim 4 wherein said second cam has a recessed portion for receiving a key of a keeper for locking said housing to said keeper.

6. The latch according to claim 5 wherein said first cam prevents said second cam from rotating when said second cam is accessed from underneath said housing.

7. The latch, according to claim 6, wherein said locking mechanism is configured so that said handle travels about 180 degrees from said locked position to said unlocked position.

8. The latch according to claim 7 wherein said shaft has a first cylindrical portion having a first diameter, a second cylindrical portion having a smaller diameter than the diameter of the first cylindrical portion and a third rectangular portion.

9. The latch according to claim 8 wherein said rectangular portion couple with an opening in said first cam.

10. The latch according to claim 7 wherein said second cam has a second groove that on a side of the cam that is adjacent to a protrusion on an interior surface of said housing and configured to mate with said protrusion to restrict the angle of rotation of the said second cam.

11. The latch according to claim 10 wherein said second cam has an opening through which said shaft passes that allows the second cam not only to rotate around its axis but also to shift relative to the housing and said first cam.

* * * * *